US006997427B2

(12) United States Patent
Manthei

(10) Patent No.: US 6,997,427 B2
(45) Date of Patent: Feb. 14, 2006

(54) FORM FOR CASTING CONCRETE BLOCK COLUMN

(75) Inventor: Benjamin R. Manthei, Petoskey, MI (US)

(73) Assignee: Redi-Rock International, LLC, Charlevoix, MI (US)

( * ) Notice: Subject to any disclaimer, the term of this patent is extended or adjusted under 35 U.S.C. 154(b) by 233 days.

(21) Appl. No.: 10/439,530

(22) Filed: May 16, 2003

(65) Prior Publication Data

US 2004/0227053 A1 Nov. 18, 2004

(51) Int. Cl.
*B28B 7/06* (2006.01)

(52) U.S. Cl. ..... 249/83; 249/48; 249/51; 249/166; 249/168; 249/170

(58) Field of Classification Search ..... 249/48, 249/51, 83, 164, 166, 167, 168, 170; 425/188
See application file for complete search history.

(56) References Cited

U.S. PATENT DOCUMENTS 767,829 A 8/1904 Ozee
788,481 A 4/1905 Lightner
789,996 A 5/1905 McCullough
799,754 A 9/1905 Petrie
1,599,035 A * 9/1926 Baumberger ..... 249/48
2,975,498 A * 3/1961 Plattner ..... 249/48
4,008,026 A * 2/1977 Engstrom ..... 425/117
4,887,789 A * 12/1989 Harris et al. ..... 249/16
5,535,981 A * 7/1996 Goris ..... 249/157

* cited by examiner

*Primary Examiner*—Donald Heckenberg
(74) *Attorney, Agent, or Firm*—MacMillan, Sobanski & Todd, LLC

(57) ABSTRACT

A form for casting concrete columns which simulate a stack of stone blocks. The form includes first and second side sections, each including two side panels. The side sections are releasably connected together to form a rectangular frame which has closed and open positions. The frame and a base on which the frame rests supports a column side insert. The column side insert has a central opening in which a column is cast. The column side insert imparts a desired appearance to the exterior sides of the cast column. After a column is cast, the side sections are moved to an open position and the column side insert is separated from the column. The form may include inserts for forming passages in the column and for forming one or more notches in the column for receiving fence rails

18 Claims, 6 Drawing Sheets

FORM FOR CASTING CONCRETE BLOCK COLUMN

CROSS-REFERENCE TO RELATED APPLICATIONS

Not Applicable.

STATEMENT REGARDING FEDERALLY SPONSORED RESEARCH OR DEVELOPMENT

Not Applicable.

TECHNICAL FIELD

The invention relates to a form for casting a decorative concrete column suitable for use, for example, as a bench support or as a support for a fence.

BACKGROUND OF THE INVENTION

Fences are sometimes constructed from stone block columns which are built on site by stacking stone blocks which are held together with mortar. Rails are mounted to extend between the columns. The rails may be mounted, for example, in recesses which are formed in the columns as the blocks are stacked. Optionally, a concrete cap may be placed on top of the column to provide a finished appearance. The construction of columns from stone blocks can be quite expensive, particularly due to labor costs. However, fences formed from rails running between stone block columns can be quite attractive. Block columns also have been used to support benches, to form bases for lamps, and for other decorative and architectural applications.

BRIEF SUMMARY OF THE INVENTION

The invention is directed to a form for casting concrete columns having a decorative side. The column side, for example, may simulate stacked stone blocks. The form includes at least two side sections which are releasably secured together around a resilient column side forming insert which has an open top and an open bottom. The side sections may be moved between a closed position for casting a column and an open position for removing a cast column from the form. While casting a concrete column, the form is supported on a base. After the column is cast, the side sections and the insert may be opened for removal of the column, or they may be first inverted before opening and removing the column. Optionally, a lifting insert may be secured to the support for holding a rod which is embedded in and extends across a recess formed by the lifting insert in the top of a column which is cast upside down in said form. One or more inserts also may be positioned on the support for forming one or more notches in the top of the cast column for receiving ends of fence rails. Optionally, a tube or an insert may be positioned in the form for forming a vertical passage in the cast column for passing wiring or plumbing. Further, an optional channel may extend from a center passage to a side of the column for securing a gate hinge.

Various objects and advantages of the invention will become apparent from the following detailed description of the invention and the accompanying drawings.

DETAILED DESCRIPTION OF THE INVENTION

Figure 1:
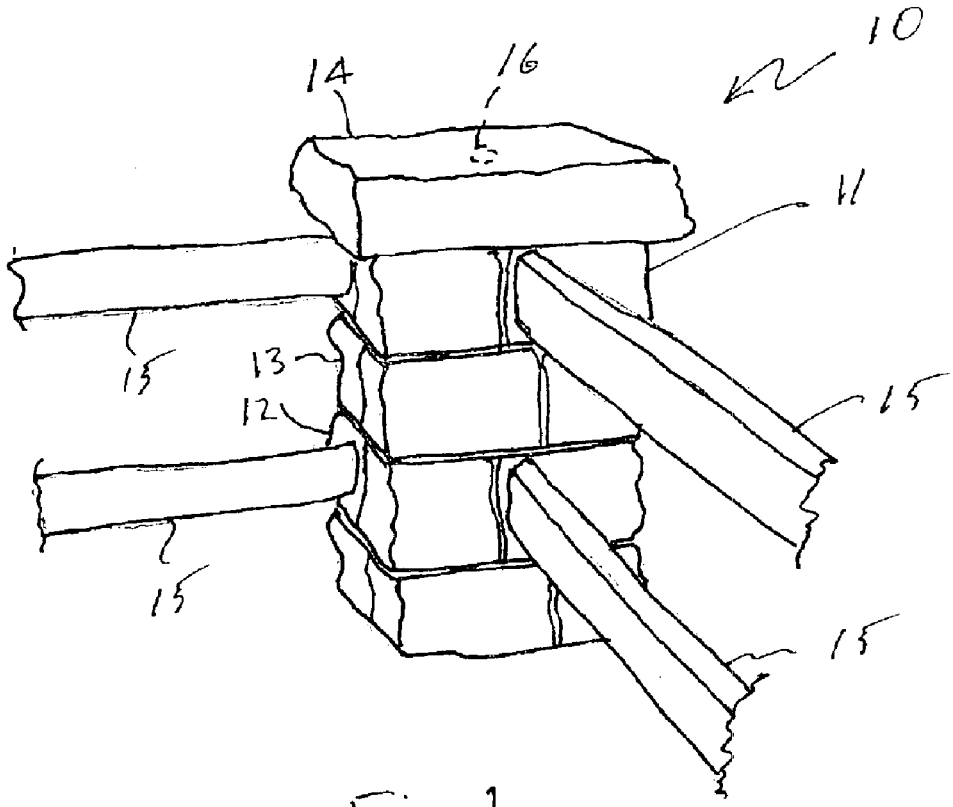
FIG. 1 is a fragmentary perspective view showing an exemplary corner post for a fence constructed from two concrete block columns cast in a form according to the invention.

Referring first to FIG. 1 of the drawings, a portion of a fence 10 is shown having a corner post 11 formed from two stacked block column sections 12 and 13, a cap 14 positioned on top of the upper block column section 13, and fence rails 15. The fence rails fit into notches formed in the corner post 1. Optionally, a vertical passage 16 may be formed through the corner post 11 for passage of electrical wires so that an optional light can be mounted on the corner post 11.

The column sections 12 and 13 are preferably formed to simulate stacks of cobble stones or of cut stone blocks. Each section 12 and 13 is shown as being formed with two tiers of simulated stone blocks, with four blocks in each tier. The surfaces of each column section 12 and 13 may also be stained or colored for aesthetics to more accurately simulate natural rocks.

Figure 2:
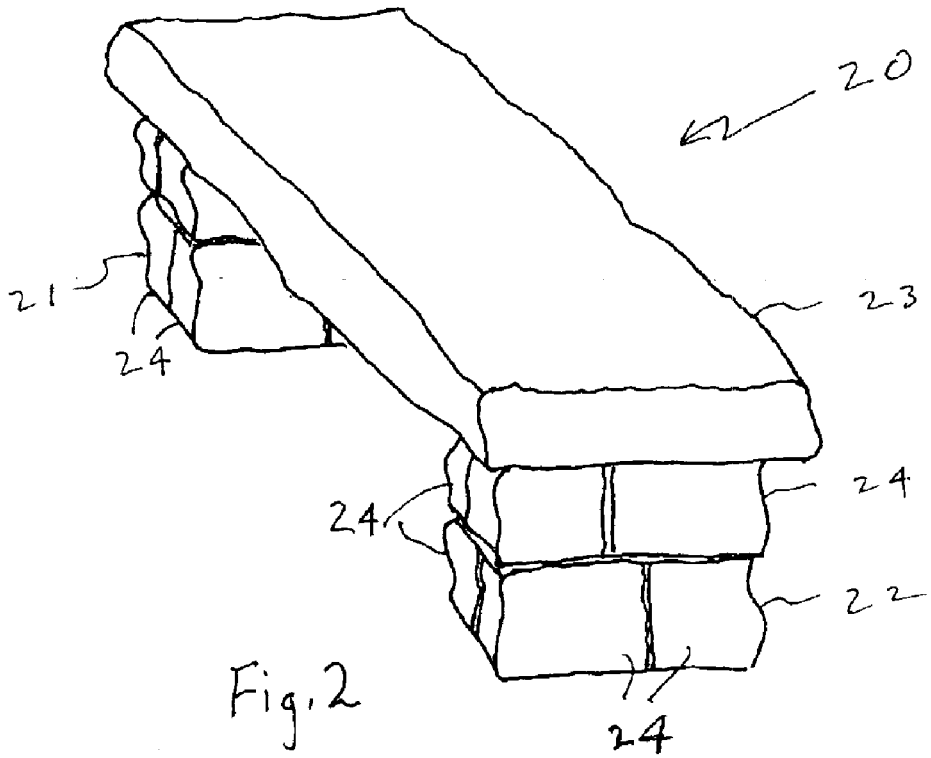
FIG. 2 is a perspective view showing a bench formed from a concrete slab and from two concrete columns cast in a form according to the invention.

FIG. 2 shows an exemplary bench 20 formed from two cast concrete columns 21 and 22 and a cast concrete slab 23. Each column 21 and 22 is formed to simulate a stack of blocks 24 which simulate blocks of natural stone. The slab 23 also may be textured and, optionally, colored to simulate natural stone.

Figure 3:
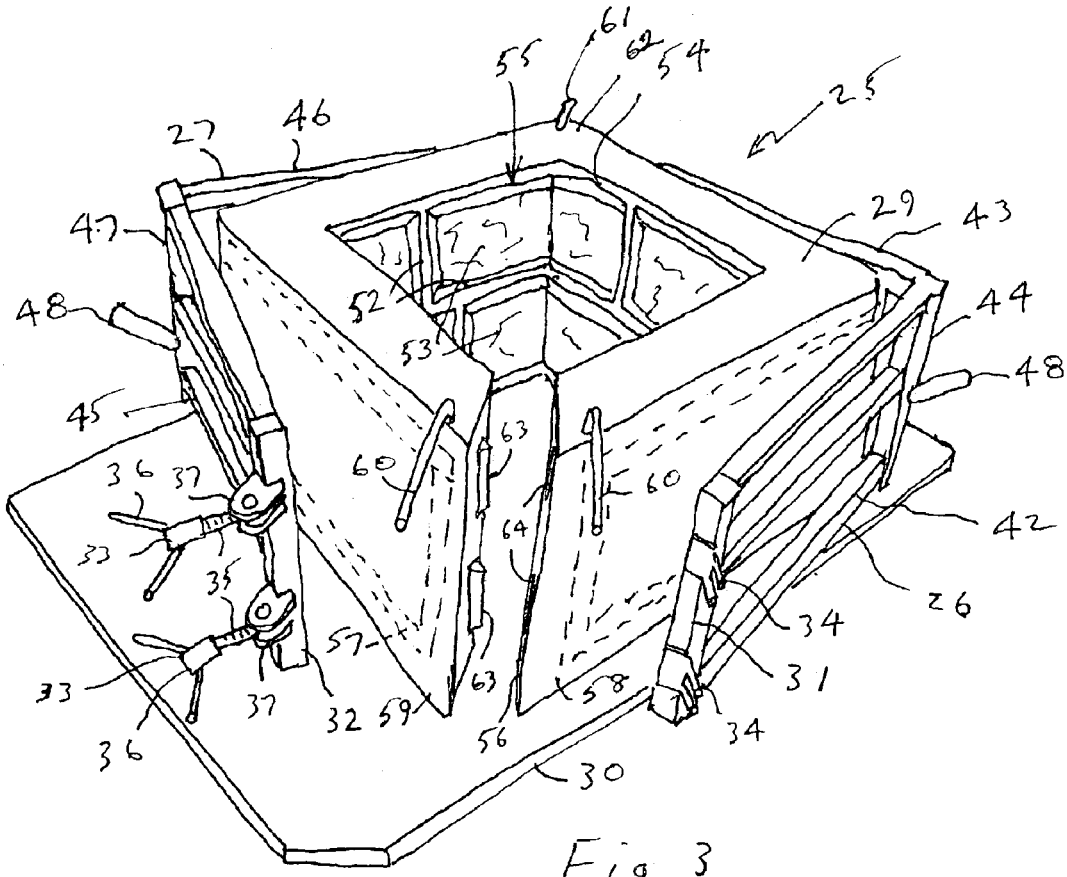
FIG. 3 is a perspective view of a form according to the invention, with the form shown in an open position.
Figure 4:
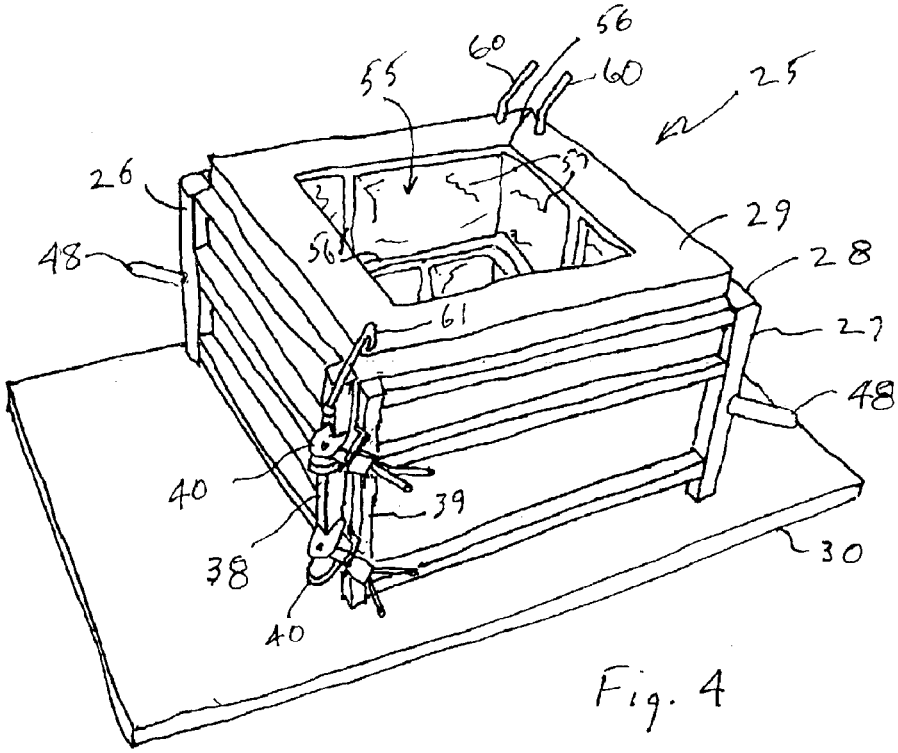
FIG. 4 is a perspective view of the form of FIG. 3, with the form shown in a closed position.

FIGS. 3 and 4 show details of a form 25 according to the invention for casting the concrete block columns 12, 13, 21 and 22 of FIGS. 1 and 2. The form 25 generally includes two side sections 26 and 27 which are releasably locked together to form a frame 28 which encloses and supports a column side insert 29, and a base 30 on which the frame 28 and the column side insert 29 rest. The frame sections 26 and 27 each have a first end 31 and 32 (FIG. 3), respectively, which are releasably locked together with clamps 33. Each of the clamps 33 is shown as including a forked bracket 34 mounted on the end 31 of the side section 26 and of a bolt 35 attached to the end 32 of the side section 27. When the side sections 26 and 27 are closed together with the ends 31 and 32 abutting, the bolt 35 passes between tines on the forked bracket 34 and a wing nut 36 is tightened on the bolt 35 to lock together the side section ends 31 and 32. The bolts 35 may be in the form of eye bolts which are secured to brackets 37 on the side section end 32 so as to rotate.

The side sections 26 and 27 have second ends 38 and 39, respectively, which may be either hinged together, or releasably locked together with clamps 40, which may be of a construction similar to the clamps 33. The side sections 26 and 27 must be moved to an open position (FIG. 3) in order to remove a cast column from a cavity 41 formed in the column side insert. If the side sections 26 and 27 are hinged together at the second ends 38 and 39, the side sections are opened by releasing the clamps 33 and pivoting the side sections about the hinge. If the side sections 26 and 27 are locked together at the second ends 38 and 39, all of the clamps 33 and 40 are released to allow the side sections 26 and 27 to be separated when to an open position.

If a block column cast in the form 25 is rectangular, the side section 26 may be formed form two side panels 42 and 43 which are connected together at a corner post 44 to extend at right angles to each other, and the side section 27 may be formed from two side panels 45 and 46 connected together at a corner post 47 to extend at right angles to each other. The side panels 42, 43, 45 and 46 are shown as being constructed from tubes welded together to form rectangular frames. The number of tubes and the size of the tubes will be determined by the strength required for a particular form size. Optionally, a pin 48 is attached to each corner posts 44 and 47. When the form is in the closed position with the side sections locked together and on the base 30 for casting a block, the pins are aligned on a horizontal axis, which is preferably at or slightly below the vertical center of the form 25. The pins allow the form 25 to be picked up using, for example, a fork lift and chains, and the form 25 to be inverted prior to opening and removing a cast column. Thus, the top of a column cast in the form 25 will be shaped either by the base 30 or by an insert positioned on the base 30.

The illustrated column side insert 29 is rectangular in plan with a vertical central opening 54 which together with the base 30 form a cavity 55 in which the column is cast. Interior walls of the column side insert 29 are provided with ridges 52 separating textured areas 53 which provide a desired exterior appearance to a block column cast in the form 25. The areas 53 may be textured to simulate the surfaces of natural stones and stone blocks, while the ridges 52 form the seams between adjacent stones or blocks. If desired, a suitable dye or stain may be applied to the interior surfaces of the column side insert 29 prior to casting a column to impart a desired coloration to the sides of the column.

The column side insert 29 is shown as having a mitered cut or opening 56 at one corner. The insert 29 is formed from a resilient material, such as a durable rubber. Metal straps 57 or other reinforcements may be embedded in the insert 29, as needed. When the side sections 26 and 27 are in the open position, sides 58 and 59 may be separated at the cut 56 to sufficiently enlarge the cavity 55 to allow removal of a cast column. If desired, a rod 60 may be embedded in each side 58 and 59 to define a handle for separating the sides. A rod 61 also may be embedded in a diagonal corner 62 of the insert 29 to form a handle to facilitate moving the insert.

It is sometimes desirable to cast the column upside down in the cavity 55 so that the top of the column is formed by the base 30 or by an insert on the base 30. In that situation, the handles formed by the rods 60 and 60 will be placed adjacent the base 30 while the column is cast. Once the column has cured sufficiently, the pins 48 may be used to lift the side sections 26 and 27, the insert 29 and the cast column from the base 30, and to invert them so that the top of the column is up prior to opening the side sections 26 and 27.

Optionally, one or more tongues 63 and grooves 64 or other interlocking configurations may be formed on the sides of the mitered cut 56 to align the sides 58 and 59 when they are moved together. It will also be appreciated that the insert 29 also may be cut at the diagonal corner 62 so that the insert 29 separates into two halves when the form 25 is opened.

Figure 5:
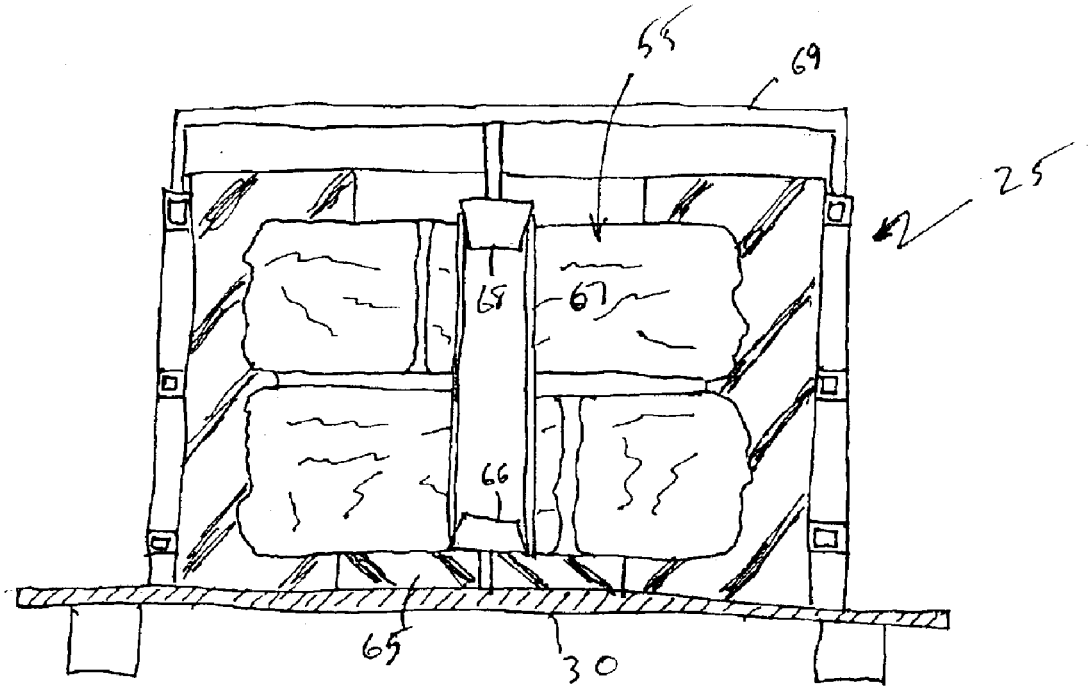
FIG. 5 is a cross sectional elevational view of the form of FIG. 3 with an insert for producing a vertical opening in a block cast in the form.

FIG. 5 is a cross sectional view of the form 25, showing a method for forming a vertical passage through the cast column. An insert 65 is places on the base 30 to cover the bottom of the cavity 55. The insert 65 includes a truncated conical projection 66 at a desired location for forming a vertical passage in the cast column. A length of pipe 67 of PVC, cardboard, or other suitable material is positioned on the projection 66. The pipe 67 is cut to have the same length as the height of the cast column. A conical member 68 is positioned in an upper end of the pipe 67 and is supported by a suitable frame 69. After the column is cast, the frame 69 and member 68 are removed before removing the column from the cavity 55. The resulting column will then have a vertical passage suitable, for example, for running electrical wires or plumbing.

Figure 6:
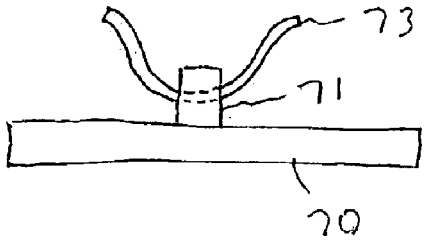
FIG. 6 is an elevational view of an insert for the form according to a modified embodiment of the invention for forming a lifting hook in a concrete column cast in the form.
Figure 7:
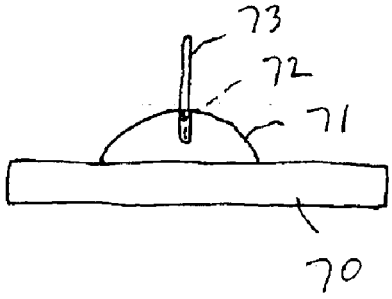
FIG. 7 is an elevational view of the insert of FIG. 6, with the insert rotated 90° about a vertical axis.
Figure 8:
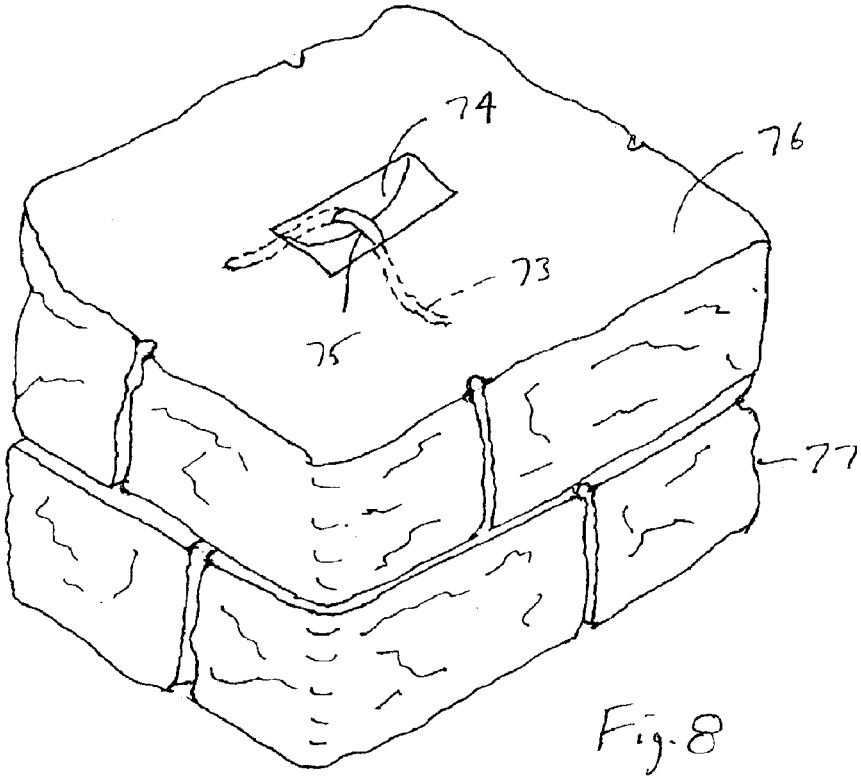
FIG. 8 is a perspective view of a concrete column showing a lifting hook made with the insert of FIGS. 6 and 7.

Alternately, an insert 70 shown in FIGS. 6 and 7 may be placed in the bottom of the cavity 55. The insert 70 has a semi-circular projection 71 which forms a semicircular recess in an end of a column. The projection 71 has a vertical cut 72 in its center which connects to an opening adapted to receive a rod 73. The rod 73 will be embedded in the column, except for the portion spanning the recess formed in the column end. When a cast column is separated from the insert 70, the projection 71 will be withdrawn from the recess and the rod 73 will be pulled through the cut 72, leaving a recess 74 with a lifting hook 75 in an end 76 of the cast column 77. If the column is inverted prior to opening the form, the lifting hook will be at the top of the column, as shown in FIG. 8.

Figure 9:
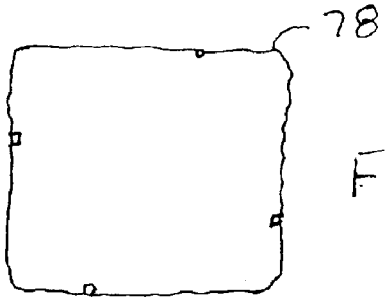
FIG. 9 is a top plan view showing a column without any fence rail notches.
Figure 10:
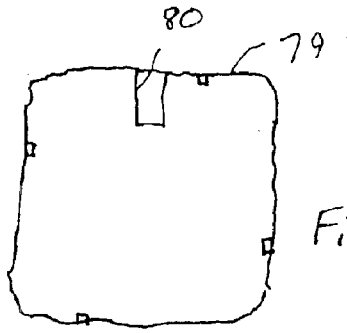
FIG. 10 is a top plan view showing a column with a single fence rail notch in one side.
Figure 11:
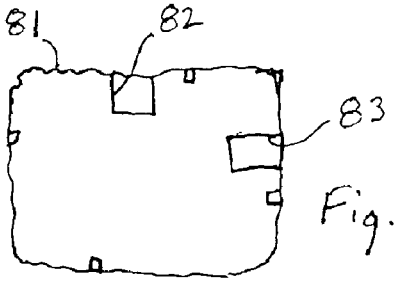
FIG. 11 is a top plan view showing a column with fence rail notches in two adjacent sides.
Figure 12:
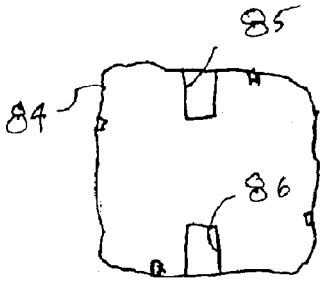
FIG. 12 is a top plan view showing a column with fence rail notches in two opposed sides.

As discussed above, the cast column may be provided with notches for receiving fence rails. FIG. 9 is a top plan view of a column 78 which does not have any fence rail notches. FIG. 10 is a top plan view of a column 79 having a single fence rail notch 80. FIG. 11 is a top plan view of a column 81 having two fence rail notches 82 and 83 on adjacent sides for forming a corner of a fence similar to the fence 10 shown in FIG. 1. FIG. 12 is a top plan view showing a column 84 having two fence rail notches 85 and 86 on opposite sides of the column 84.

Figure 13:
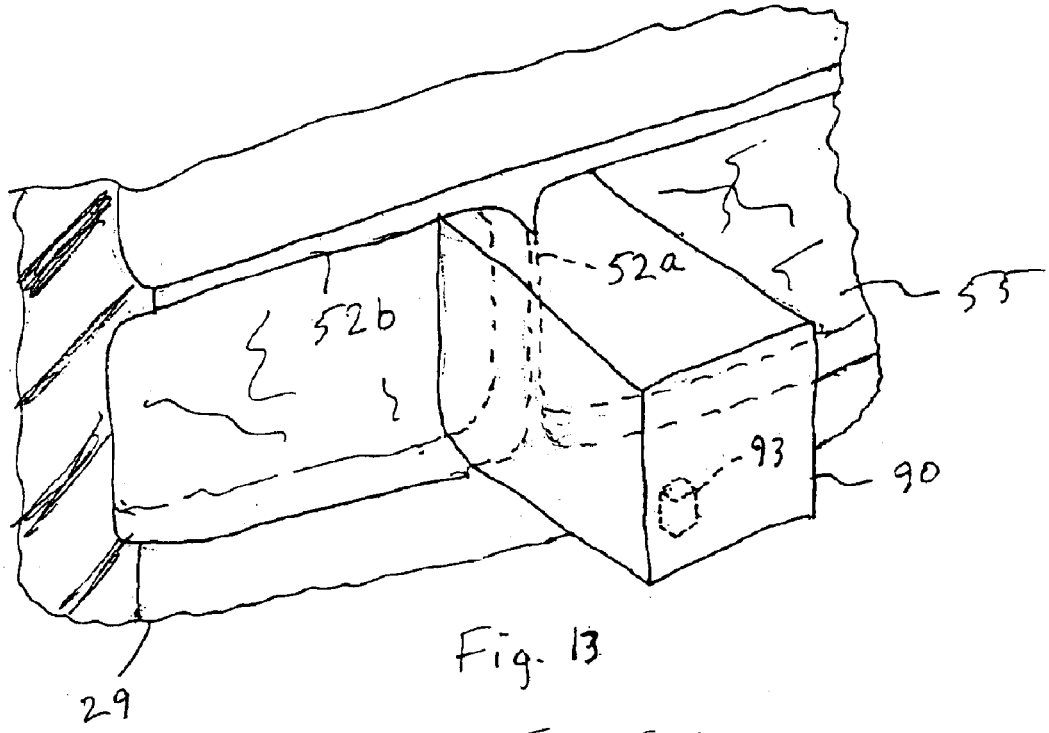
FIG. 13 is a fragmentary perspective view showing a portion of the column side insert for the form, with a notch forming insert.
Figure 14:
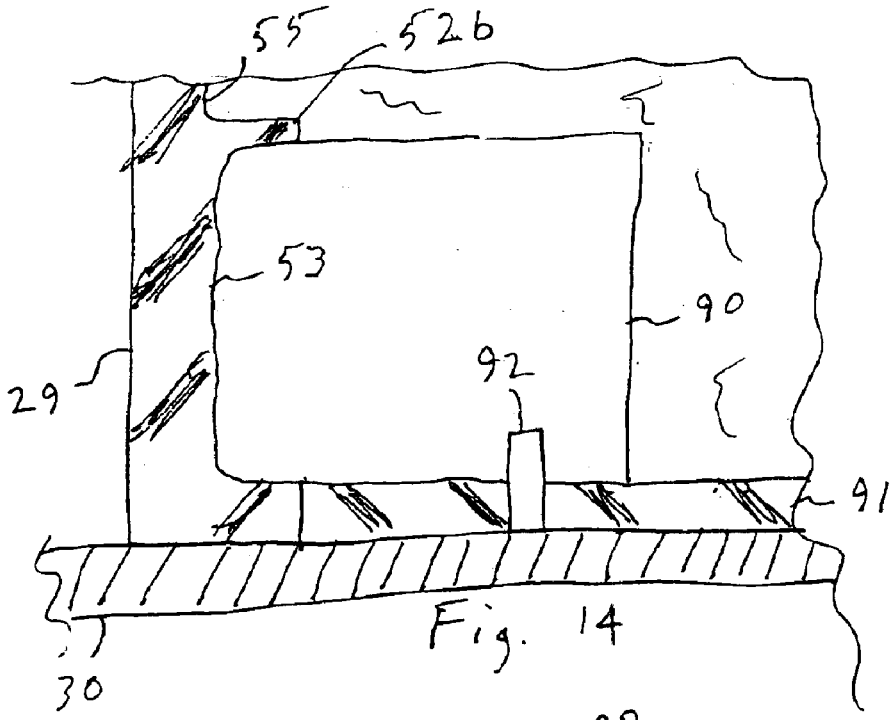
FIG. 14 is an enlarged fragmentary cross sectional view showing details of the notch forming insert.
Figure 15:
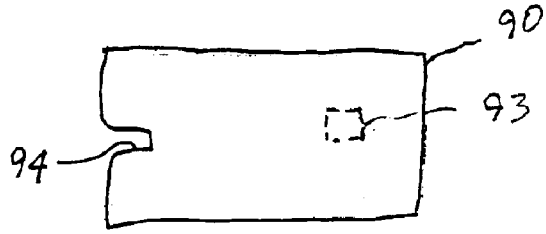
FIG. 15 is a top plan view of the notch forming insert.

FIGS. 13–15 show details of a rail insert 90 for forming a fence rail notch in a column cast in the mold cavity 55. An end of a cast column may be cast by the base 30 or by a base insert 91 placed on the base 30. A key 92 is attached to either the base 30 or the base insert 91 for positioning the rail insert 90. The rail insert 90 has an opening 93 shaped to receive the key 92. The rail insert 90 also is positioned by a vertical groove 94 which fits over a vertical ridge 52*a* on the column side insert 55. The rail insert 90 also fits under a horizontal ridge 52*b* to prevent movement of the rail insert 90 when a concrete column is poured. It will be appreciated that a key 92 will be used for each rail insert 90 when more than one rail notches are to be formed in a column.

Figure 16:
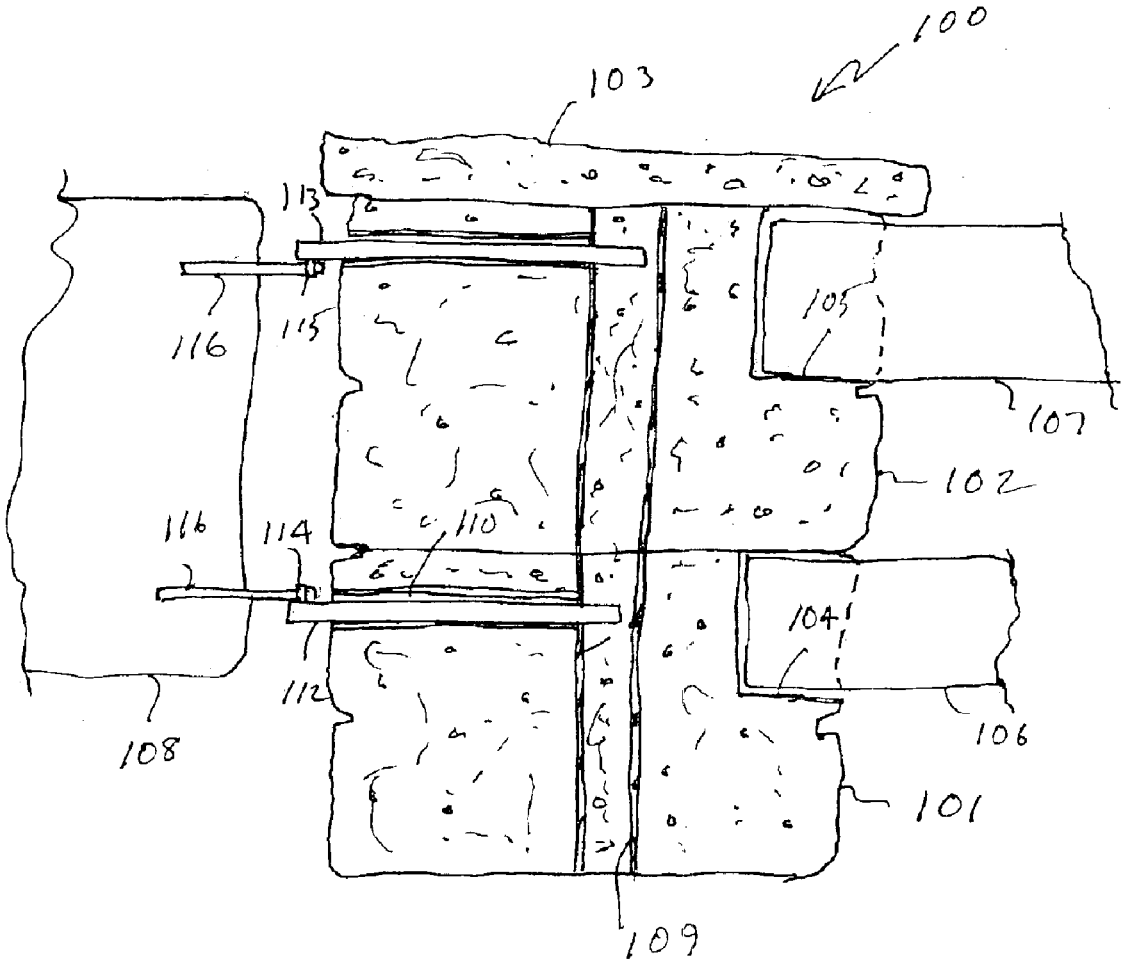
FIG. 16 is a cross sectional view of a fence post formed from two stacked columns made in a form according to the invention, with attached gate hinge brackets.

FIG. 16 is a cross section through a modified fence post 100 formed from 2 concrete block columns 101 and 102 and a cap 103. The columns 101 and 102 have rail notches 104 and 105 securing ends of fence rails 106 and 107, respectively. A gate 108 also is mounted on the fence post 100. The fence post 100 is formed with a vertical passage 109. A square tube 110 and 111 is embedded in each column 101 and 102, respectively, to extend from the passage 109 to a side location where a gate hinge is desired. A lower hinge rod 112 is positioned to extend through the tube 110 into the passage 109 and an upper hinge rod 113 is positioned to extend through the tube 111 and into the passage 109. The passage 109 may then be filled with concrete to retain the hinge rods 112 and 113. The lower hinge rod 112 has an upwardly directed hinge pin 114 and the upper hinge rod 113 has a downwardly directed hinge pin 115 in axial alignment with the pin 114. The gate 108 is provided with hinge sections 116 which engage the hinge pins 114 and 115.

It will be appreciated that various modifications and changes may be made to the above described preferred embodiment of without departing from the scope of the following claims. Although the form has been described for casting concrete block columns which simulate natural stones and stone blocks, it will be appreciated that the column side insert may be configured to provide other surface configurations to the cast column. For example, the concrete block column also may simulate a column formed from bricks and mortar, or from wood.

What is claimed is:

1. A form for casting a concrete column having sides, a top and a bottom comprising first and second side sections each having a first end and a second end, means connecting together said first ends of said first and second side sections while permitting said side sections to be moved between open and closed positions, a releasable lock for locking together said second ends of said first and second side sections when said form is in said closed position and for permitting said form to be moved to an open position when said lock is released, a resilient one piece column side insert positioned between said first and second side sections, said column side insert having integral sides which are supported by said side sections when said side sections are in said closed position, an open top, an open bottom and an interior surface shaped to provide a desired shape and surface texture to the sides of a concrete column cast in said form, and a base for supporting said side sections and said column side insert while casting a concrete column.

2. A form for casting a concrete column, as set forth in claim 1, and wherein said means connecting together said first ends of said first and second side sections comprises a releasable lock.

3. A form for casting a concrete column, as set forth in claim 1, and wherein said means connecting together said first ends of said first and second side sections comprises a hinge.

4. A form for casting a concrete column, as set forth in claim 1, and wherein said column side insert has two edges which may be separated by bending said insert when said side sections are in said open position.

5. A form for casting a concrete column, as set forth in claim 4, and wherein said column side insert includes a handle adjacent each of said two edges to facilitate manual separation of said edges.

6. A form for casting a concrete column having sides, a top and a bottom comprising first and second side sections each having a first end and a second end, means connecting together said first ends of said first and second side sections while permitting said side sections to be moved between open and closed positions, a releasable lock for locking together said second ends of said first and second side sections when said form is in said closed position and for permitting said form to be moved to an open position when said lock is released, a column side insert positioned between said first and second side sections, said column side insert having sides which abut and are supported by said side sections when said side sections are in said closed position, an open top, an open bottom and an interior surface shaped to provide a desired shape and surface texture to the sides of a concrete column cast in said form, and a base for supporting said side sections and said column side insert while casting a concrete column, and wherein said handles include rods embedded in said column side insert to extend above said column side insert adjacent each of said edges when said insert and said side sections are supported on said base.

7. A form for casting a concrete column, as set forth in claim 6, and further including a handle on said column side insert at a corner opposite said rods to facilitate lifting and moving said column side insert.

8. A form for casting a concrete column, as set forth in claim 4, and wherein said column side insert edges which may be separated include at least one tongue on one of said edges and at least one groove on a second of said edges which are configured to align said edges with each other when said side sections are in said closed position.

9. A form for casting a concrete column, as set forth in claim 4, and wherein said column side insert edges are adjacent said second ends of said side sections when said side sections are in said closed position.

10. A form for casting a concrete column having sides, a top and a bottom comprising first and second side sections each having a first end and a second end, means connecting together said first ends of said first and second side sections while permitting said side sections to be moved between open and closed positions, a releasable lock for locking together said second ends of said first and second side sections when said form is in said closed position and for permitting said form to be moved to an open position when said lock is released, a column side insert positioned between said first and second side sections, said column side insert having sides which abut and are supported by said side sections when said side sections are in said closed position, an open top, an open bottom and an interior surface shaped to provide a desired shape and surface texture to the sides of a concrete column cast in said form, a base for supporting said side sections and said column side insert while casting a concrete column, and wherein said side sections each include two side panels connected together to form substantially a right angle.

11. A form for casting a concrete column, as set forth in claim 10, and wherein each side section further includes a pin attached to the connection between the section side panels to extend away from said column side insert, and wherein said pins are located at or below a center of the connection between said side panels, whereby said pins facilitate lifting said side sections, said column side insert and a concrete column cast in said column side insert for inverting the cast concrete column.

12. A form for casting a concrete column, as set forth in claim 1, and further including a column lifting insert secured to said base at substantially the center of said open bottom of said column side insert when said column side insert is supported on said base, said lifting insert being adapted to releasably hold a rod which is embedded in and extends across a recess formed by said lifting insert in the top of a column which is cast upside down in said form.

13. A form for casting a concrete column having sides, a top and a bottom comprising first and second side sections each having a first end and a second end, means connecting together said first ends of said first and second side sections while permitting said side sections to be moved between open and closed positions, a releasable lock for locking together said second ends of said first and second side sections when said form is in said closed position and for permitting said form to be moved to an open position when said lock is released, a column side insert positioned between said first and second side sections, said column side insert having sides which abut and are supported by said side sections when said side sections are in said closed position, an open top, an open bottom and an interior surface shaped to provide a desired shape and surface texture to the sides of a concrete column cast in said form, and a base for supporting said side sections and said column side insert while casting a concrete column, a column lifting insert secured to said base at substantially the center of said open bottom of said column side insert when said column side insert is supported on said base, said lifting insert being adapted to releasably hold a rod which is embedded in and extends across a recess formed by said lifting insert in the top of a column which is cast upside down in said form, and at least one notch forming insert positioned on said base adjacent said column side insert, each said notch forming insert forming a notch in a side adjacent the top of a column cast upside down in said form, and wherein each notch is sized to receive an end of a fence rail.

14. A form for casting a concrete column, as set forth in claim 13, and wherein each notch forming insert includes at least one opening adapted to engage a pin on said base for positioning said notch forming insert on said base, and wherein each notch forming insert includes an edge shaped to abut and to conform to an adjacent portion of said interior surface of said column side insert when positioned on a pin.

15. A form for casting a concrete column, as set forth in claim 14, and wherein said interior surface of said column side insert is configured to shape a concrete column cast in said form to simulate a stack of stone blocks at least two blocks high, and wherein recessed seams are formed between adjacent blocks.

16. A form for casting a concrete column, as set forth in claim 15, and wherein said interior surface of said column side insert includes ridges which form the seams between the simulated blocks forming said column, and wherein said shaped edge of said notch forming insert is shaped to engage at least one of said ridges on said column side insert.

17. A form for casting a concrete column, as set forth in claim 1, and wherein said interior surface of said column side insert is configured to shape a concrete column cast in said form to simulate a stack of stone blocks at least two blocks high, and wherein recessed seams are formed between adjacent blocks.

18. A form for casting a concrete column, as set forth in claim 10, and wherein said interior surface of said column side insert is configured to shape a concrete column cast in said form to simulate a stack of stone blocks at least two blocks high, and wherein recessed seams are formed between adjacent blocks.

* * * * *